United States Patent [19]

Hege

[11] 3,934,857

[45] Jan. 27, 1976

[54] MIXING AND HEAT TRANSFER APPARATUS

[75] Inventor: Douglas W. Hege, Woodland Hills, Calif.

[73] Assignee: Hege Advanced Systems Corporation, Huntington Beach, Calif.

[22] Filed: Nov. 16, 1973

[21] Appl. No.: 416,520

[52] U.S. Cl. ..... 259/8; 165/87; 165/94; 165/109; 165/142; 165/169; 259/96; 259/DIG. 18

[51] Int. Cl.[2] ..... B01F 5/16; B01F 15/06

[58] Field of Search ..... 259/7, 8, 23, 24, 43, 46, 259/96, 106, 107, 108, DIG. 18; 165/87, 94, 109, 169, 142

[56] References Cited

UNITED STATES PATENTS

| | | | |
|---|---|---|---|
| 1,560,826 | 11/1925 | Kirschbraum | 259/7 |
| 2,071,393 | 2/1937 | Doherty | 259/7 |
| 2,102,548 | 12/1937 | Stratford | 259/8 |

*Primary Examiner*—Edward L. Roberts
*Assistant Examiner*—James A. Niegowski
*Attorney, Agent, or Firm*—Kenyon & Kenyon Reilly Carr & Chapin

[57] ABSTRACT

An improved apparatus for mixing and reacting materials that include at least one liquid while simultaneously transferring heat to or from the mixture. A rotating centrifugal impeller mounted in a lower chamber of a closed reactor vessel draws the materials to be mixed from an upper chamber through a short central inlet and mixes them with high energy while impelling them between spaced blades extending outward from the eye of the impeller to a high pressure region at its circumference. The mixture then returns to the upper chamber through a plurality of elongated conduits having thin walls. For maximum heat transfer area in relation to cross-sectional flow area, each conduit is arranged with a first inner portion of annular cross section and a second, reverse flow, outer portion separated from the inner portion by a double-walled tube, the tube having passages between its double walls for circulating heat exchanging fluid.

10 Claims, 6 Drawing Figures

1
2
3
4
5
7
8
9
10
11
13
14
15
16
18
19
20
34
36
36
60
61
67
68
69
71
72
73
74
75
76

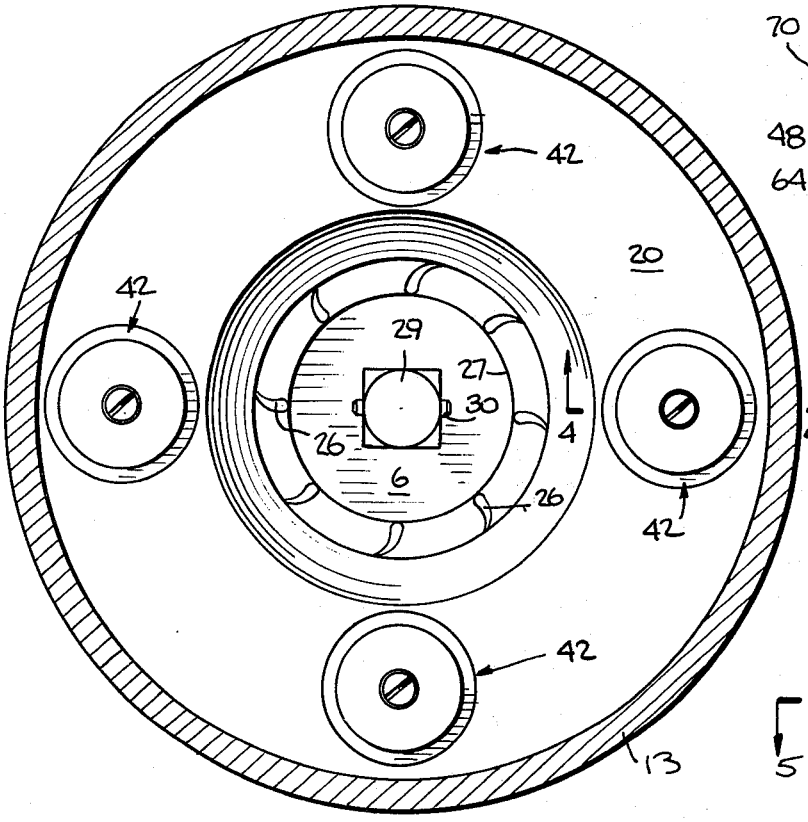
Fig. 3.
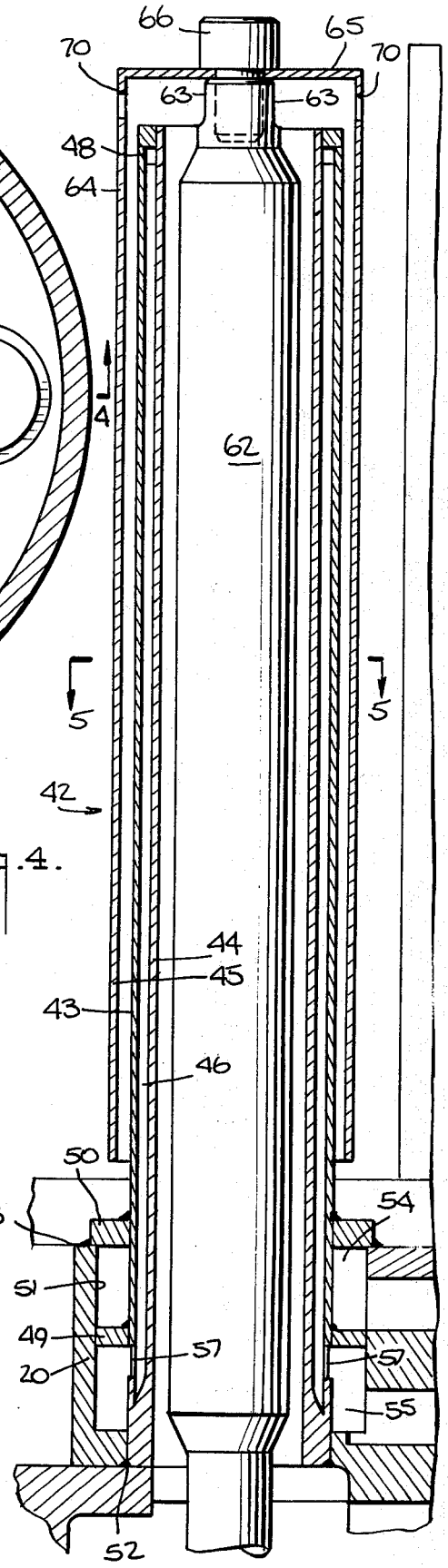
Fig. 4.
Fig. 5.
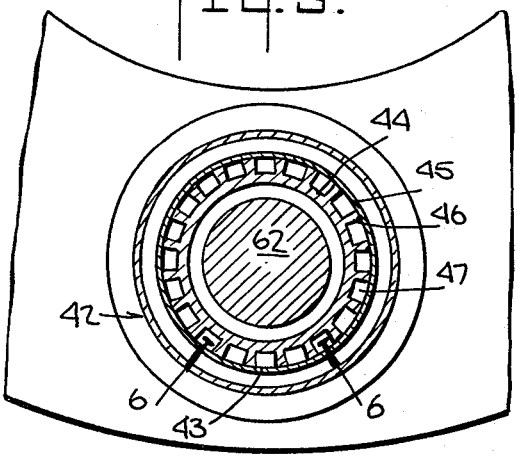
Fig. 6.
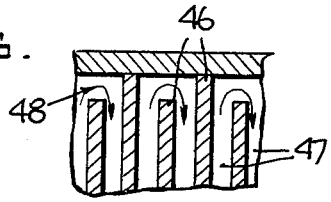

MIXING AND HEAT TRANSFER APPARATUS

BACKGROUND OF THE INVENTION

1. Field of the Invention

This invention relates to reactor mixers and more specifically to mixers having means for transferring heat to or from the materials being mixed.

2. Description of the Prior Art

Many reactions in the chemical industry are carried out in pressure tight vessels called reactors which usually have a motor driven stirrer and means for transferring heat to or from the ingredients according to the temperature requirements of the reaction. The heat transfer means normally consists of a pipe coil inside the reactor or a double-walled jacketed portion surrounding the reactor vessel for circulating heating or cooling fluids such as steam or refrigerated brine.

These conventional reactors are relatively inefficient both in their mixing effectiveness and their ability to control the reaction temperature, particularly in the cases of highly endothermic or exothermic reactions or reactions in which the optimum temperature differs substantially from the ambient temperature. In such cases, the heating and cooling systems are not adequate to transfer heat to or from all portions of the materials being mixed at rates sufficient to maintain a relatively uniform temperature throughout the mixture.

As a result, the times to complete such reactions in conventional reactors are much longer than would be obtainable under more uniform conditions, and the yields may be reduced because the reaction in localized regions of the reactor may occur at other than optimum temperature and between insufficiently mixed reactants.

High energy centrifugal pump blenders are commerically available, but they are primarily adapted for blending dry ingredients or gases into liquids in processes that do not usually involve chemical reaction and the transfer of heat to or from the mixture. An example of such blenders is the equipment sold by the Tri-Clover Division of Ladish Co. under the trademark TRI-BLENDER.

SUMMARY OF THE INVENTION

It is an object of the present invention to provide an apparatus for imparting high energy mixing action to materials including at least one liquid ingredient while simultaneously transferring heat to or from the mixed materials to obtain a desired temperature substantially uniformly throughout the mixture.

It is a further object of the invention to provide a centrifugal impeller, for high energy recirculation of a liquid mixture inside a reactor vessel, in combination with at least one elongated conduit for returning the mixture from the high pressure side of the impeller to the low pressure side at high velocities past a heat transferring wall surface, with the flow cross section dimension normal to the heat transferring surface being small relative to the cross section dimension of said surface for efficient heat transfer and uniform temperature change in the liquid mixture.

Another object of the invention is to provide a heat exchanging mixer as described in which the heat exchanging elements can be readily removed for cleaning or replacement.

Yet another object of the invention is to provide a high pressure heat exchanging mixer in which the heat transfer elements are small in cross-section to permit thin wall construction for maximum heat transfer even with high pressure differentials.

These and other objects that will become apparent from the following description are achieved in an apparatus including a container, preferably a closed pressure vessel, for the materials to be mixed, a centrifugal impeller mounted near the bottom of the container for rotation about an approximately vertical axis, and a structure enclosing the impeller for separating the impeller from the upper portion of the container. The structure has a central inlet coaxial with the impeller axis of rotation for admitting the materials from the container to the center of the impeller and at least one outlet, preferably a plurality of circumferentially spaced outlets, for the liquid mixture that flows from the impeller.

The at least one outlet leads to one end of at least one passageway, the other end of the passageway opening into the upper portion of the container. An important feature of the invention includes means for maintaining a wall of the passageway at a temperature different from the temperature of the mixture flowing through the passageway for causing heat transfer between the wall and the flowing mixture.

Another important feature is that the flow cross section of the passageway has a dimension normal to the heat transferring surface that is much smaller than the dimension of that surface; so that the liquid mixture flows past the heat transferring surface in a relatively thin layer for optimum heat transfer to and uniform temperature change in the flowing mixture. Preferably, the passageway is annular in cross section, with one wall comprising the heat transferring surface and the radial distance between inner and outer walls being a fraction of the mean radius of the annulus.

In the preferred embodiment of the invention the heat exchanging passageways are formed by a plurality of double-walled tubes, each tube being connected at one end to a corresponding one of a plurality of circumferentially spaced outlets for the liquid mixture flowing from the impeller and discharging at the other end into the upper portion of the container. A heat transfer fluid having a temperature different from the temperature of the liquid mixture is introduced into the space between the inner and outer walls of each double-walled tube for transferring heat across the tube walls between the fluid and the liquid mixture. Preferably, the space between the inner and outer walls is subdivided by circumferentially spaced longitudinal partitions into a plurality of passageways extending from one end of each double-walled tube to the other end.

The space between the inner and outer walls of each double-walled tube is sealed at the ends, and every second longitudinal partition extends the full distance between the seals. The intermediate longitudinal partitions extend from the seal at one end to a point short of the seal at the other end; so that adjacent pairs of the longitudinal passageways communicate through an opening between the seal at the other end and the end of the intermediate partition.

Openings through the outer wall near the one end of the double-walled tube into each longitudinal passageway permit introduction of the heat transfer fluid into one of each pair of longitudinal passageways for flow to the other end of the tube, through the communicating opening between passageways, and return through the other passageway of the pair to the one end of the tube. The inlet and outlet openings for the heat transfer fluid are axially displaced and communicate with separate circumferential plenum chambers for respectively supplying and withdrawing the heat transfer fluid.

To provide an annular passageway for the liquid mixture flowing from the impeller into the double-walled tube, a cylindrical rod extends coaxially through the double-walled tube from one end to the other, the liquid mixture being confined within the space between the rod and the inner wall of the double-walled tube. The cylindrical rod also preferably serves as a cantilevered support for a second tube, coaxially surrounding the double-walled tube and having a sealed end spaced from the other end of the double-walled tube so that the liquid mixture as it exits from the other end of the double-walled tube will be deflected outward and reverse itself to pass through the annular space between the outer wall of the double-walled tube and the inner surface of the second tube.

The nested arrangement of an inner cylindrical rod surrounded by a double-walled heat exchanging tube, in turn surrounded by a second tube, provides double the length of annular cross section flow passage for a given distance from one end to the other of the heat exchanging unit and effectively uses both the inner and outer surfaces of the double-walled tube for most efficient heat transfer.

One end of the inner cylindrical rod preferably is threadedly attached to the structure enclosing the impeller, and the other end preferably is fastened to the sealed end of the second tube to permit easy removal of the rod and second tube for cleaning the inner and outer heat transfer surfaces of the double-walled tube when required.

BRIEF DESCRIPTION OF THE DRAWINGS

FIG. 3 is a plan view in section of the reactor vessel taken along line 3—3 of FIG. 2.

FIG. 4 is an elevation view in section of one of the heat exchanging units taken along line 4—4 of FIG. 3.

FIG. 5 is a plan view in section of the heat exchanging unit taken along line 5—5 of FIG. 4.

FIG. 6 is a partial section view of the upper end of the heat exchanging unit taken along line 6—6 of FIG. 5.

DESCRIPTION OF THE PREFERRED EMBODIMENT

Figure 1:
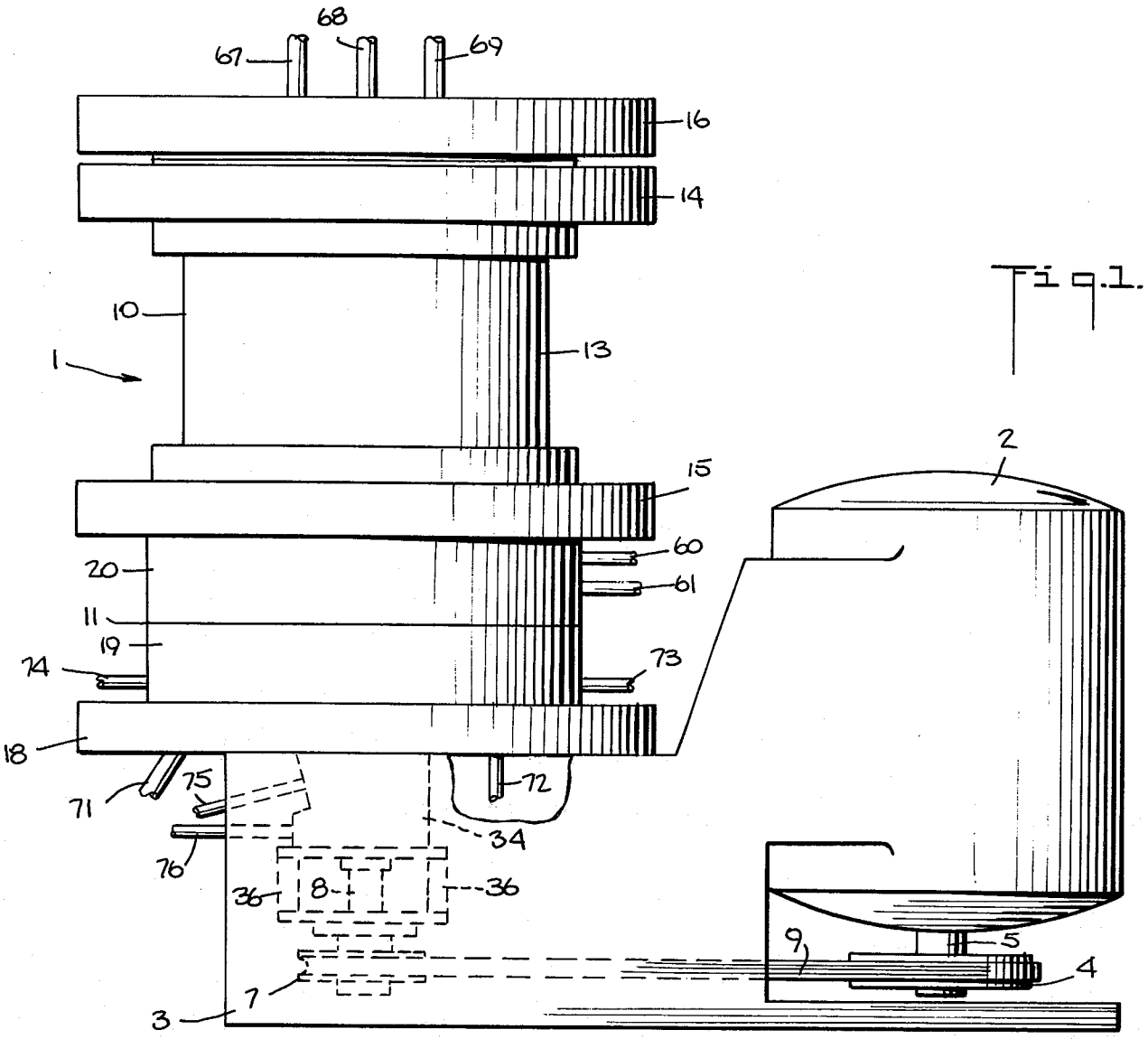
FIG. 1 is a side view of a preferred embodiment of a heat exchanging mixer assembly according to the present invention.

The complete assembly of a heat exchanging mixer shown in FIG. 1 includes a high pressure reactor vessel 1 and an electric motor 2 both mounted on a base 3. The motor is coupled through a drive pulley 4 mounted on a shaft 5 extending from the lower end of the motor housing to a centrifugal impeller 6 (FIG. 2) inside the reactor vessel through a driven pulley 7 mounted on the lower end of a vertical shaft 8 by means of a V-belt 9.

Figure 2:
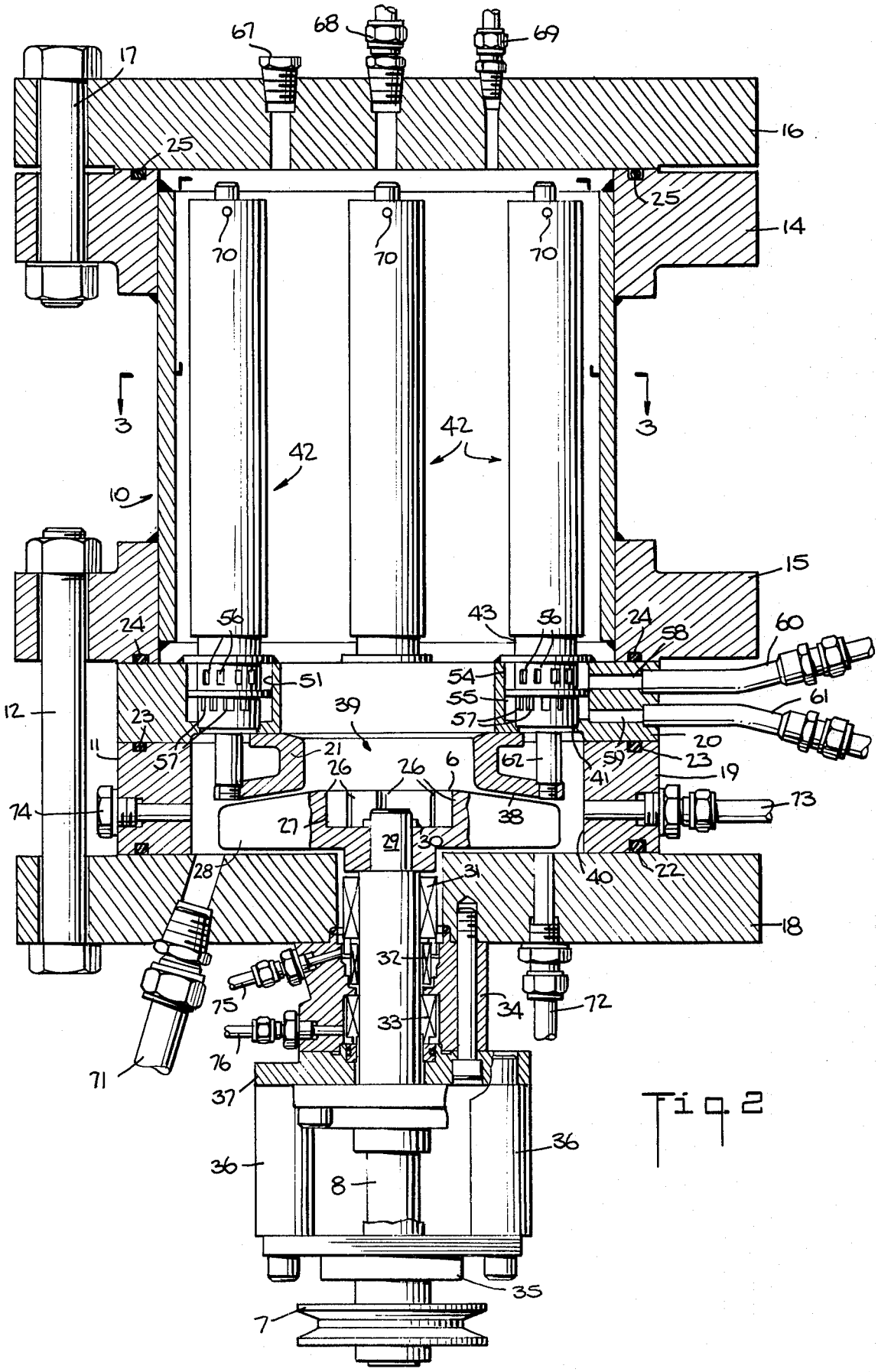
FIG. 2 is an elevation view in section of the reactor vessel of FIG. 1.

As shown in more detail in FIGS. 2 and 3, the reactor vessel preferably is designed to withstand high internal pressures and comprises an upper section 10 and a lower section 11, the two sections being held together by circumferentially spaced tie bolts 12. The upper section consists of a heavy, walled cylindrical shell 13 with respective top and bottom flanges 14 and 15 welded to each end and a cover plate 16 secured to top flange 14 by bolts 17. The lower section includes a base plate 18, and impeller enclosure ring 19 set on the base plate, a heat exchange unit support ring 20 set on enclosure ring 19, and a mixer inlet spool 21 secured by cap screws (not shown) to the lower face of support ring 20.

The interfaces between base plate 18, impeller enclosure ring 19, heat exchange support ring 20 and bottom flange 15 of upper section 10 are sealed against fluid leakage by conventional O-ring seals 22, 23, and 24, respectively. A similar O-ring 25 seals the interface between top flange 14 and cover plate 16.

Centrifugal impeller 6 is of conventional design with a plurality of blades 26 extending outwardly from an inner circumference 27 to an outer circumference 28. The impeller is detachably mounted on squared upper end 29 of vertical shaft 8 by means of friction pin 30. Shaft 8 is supported for rotation by an inboard bearing 31 and extends through pressurized packing glands 32, 33 in a stuffing box 34 to an outboard bearing 35 supported on standoff studs 36 screwed to cover plate 37 of the stuffing box.

Mixer inlet spool 21 and heat exchange unit support ring 20 together comprise a structure positioned above the impeller for separating the impeller from the upper section of the reactor. Lower surface 38 of inlet spool 21 closely follows the upper profile of impeller blades 26 with a clearance gap just sufficient to avoid contact between the blades with the spool while minimizing backflow from the high pressure side to the low pressure side of the impeller. Base flange 18 and enclosure ring 19 combine with support ring 20 and spool 21 to provide an enclosure surrounding impeller 26, the enclosure having a central inlet 39 through spool 21 for introducing a liquid mixture from upper section 10 into the eye of the rotating impeller for outward flow between blades 26 into an annular chamber formed between the outer circumference 28 of the impeller and inner wall surface 40 of enclosure ring 19. A plurality of outlets 41 circumferentially spaced around central inlet 39 permit the liquid mixture to flow upward from the annular chamber into heat exchange units 42.

The construction of the heat exchange units is shown in detail in FIGS. 4–6. Each unit 42 comprises a double-walled tube 43 consisting of a thin inner shell 44 and a thin outer shell 45 supported in spaced concentric relation to the inner shell by a plurality of circumferentially spaced longitudinal partitions 46. The space between the inner and outer shells is closed at both the bottom and top of the tube to seal the longitudinal passageways formed between partitions 46 from the liquid mixture inside the reactor.

Although double-walled tube 43 may be fabricated in any convenient manner, one method comprises milling parallel slots or grooves in the outer wall of a thick-walled tube to form longitudinal passageways 47 alternating with longitudinal partitions 46. The thin outer shell 45 is then slipped over the machined inner tube and the ends welded to seal the space between the shells.

Before the two shells are assembled, a short length of alternate partitions 46 should be removed to create an opening between the longitudinal passageways on each side of these shortened partitions after the shells are slipped together and the ends sealed. At the opposite end of the assembled double-walled tube are welded a first annular ring 49, spaced axially a predetermined distance from the opposite end of the tube, and a second annular ring 50, spaced axially a predetermined distance from the first ring. The outer diameter of ring 49 is sized to just fit within a counterbored portion 51 of each outlet 41 in heat exchange unit support ring 20, and ring 50 is slightly larger to serve as a stop against the top surface of ring 20 when the opposite end of each double-walled tube is inserted in the corresponding outlet 41. The tube end and ring 50 are then welded or brazed to the bottom and top surfaces of ring 20 at junctions 52 and 53, respectively, so as to secure the double-walled tube to the support ring and to form an annular sealed chamber divided into respective upper and lower plenums 54 and 55 by ring 49.

As best seen in FIGS. 2 and 4, outer shell 45 is pierced near its lower end by two axially spaced rows of circumferentially spaced openings 56 and 57, the upper row of openings 56 connecting upper plenum chamber 54 with alternate longitudinal passageways 47 on one side of each shortened partition 46 and the lower row of openings 57 connecting lower plenum chamber 55 with alternate longitudinal passageways 47 on the other side of each shortened partition 46. In this way, heat transfer fluid having a temperature different from the temperature of the liquid mixture flowing inside the double-walled tube can be introduced into one of the plenums to flow into one row of openings 56, 57, upward through the corresponding passageway 47, across the top of the intermediate shortened partition 46 through corresponding opening 48, down the passageway 47 on the other side of the intermediate partition, and out the other row of openings into the other of the plenums.

The heat transfer fluid is supplied to the one plenum and withdrawn from the other through radial passageways 58, 59 connected through lines 60, 61 to common supply and exhaust manifolds (not shown) serving each heat exchange unit. The choice of which plenum to use for supply and which for exhaust is not cirtical because both inlet and outlet openings for the heat transfer fluid are substantially at the same end of the double-walled tube.

For some applications the double-walled tubes alone may provide sufficient rate of heat transfer. Usually, however, optimum results will be achieved by guiding the liquid mixture to flow in relatively thin layers at high velocity past both the inside surface of inner shell 44 and the outside surface of outer shell 45. In the preferred embodiment this is accomplished by installing a cylindrical rod 62 coaxially inside each inner shell 44 to produce a restricted annular flow channel in the space between the rod and the inside surface of the inner shell. The restricted area results in higher flow velocities and consequently improved heat transfer coefficients between the inner shell and the liquid mixture. At the same time, increased turbulence and decreased flow thickness will produce a substantially uniform temperature change in all the liquid mixture flowing through the heat exchange units.

Each rod 62 is threaded at its lower end for mounting in a mating threaded hole in the lower flange of inlet spool 21. A pair of flats 63 at the upper end of each rod permit its installation by means of a mating wrench.

An outer single-walled tube 64 sealed at its upper end with a flat disc 65 is mounted coaxially with each double-walled tube 42 by a machine screw 66 inserted through a hole drilled through the center of disc 65 and threaded into an axial tapped hole at the upper end of each rod 62. Each rod 62 extends above the upper end of the corresponding double-walled tube 42, thereby permitting the liquid mixture flowing upward between the rod and the inner shell to deflect outward and reverse direction to flow downward through the annular space formed between outer shell 45 and outer tube 64 and finally to flow out the bottom of tube 64 and rejoin the mixture in the upper section of the reactor.

In operation of the heat exchanging mixer shown in the drawings, ingredients to be mixed are introduced through inlet lines 67, 68, and 69 in the cover plate of the reactor, the electric motor is started and brought up to desired operating speed, and heat transfer fluid of the desired temperature is fed through lines 60, 61 at a desired flow rate. The rotating impeller draws the materials to be mixed from the upper section through inlet 39 into the eye of the impeller to flow outward between the blades at increasing momentum and pressure into the annular chamber surrounding the blades. The well mixed ingredients then flow upward through the inner annular channel and then downward through the outer annular channel of each heat exchange unit to exit at the bottom of the outer tube of each unit at a desired uniform temperature to rejoin and mix with the material in the upper section.

If desired, holes 70 can be provided near the upper end of each outer tube 64 to allow a portion of the liquid mixture flowing through the heat exchange units to flow outward as high velocity streams to premix with the material entering at the top of the reactor and to improve the stirring action from top to bottom of the upper section.

A drain line 71 allows the completely mixed and reacted material to be drawn off either continuously or intermittently, and gas inlet lines 72, 73 and 74 permit the introduction of gaseous ingredients in the highest pressure region of the reactor for most rapid solution into the liquid mixture with minimum opportunity for cavitation when operating at relatively low absolute pressure inside the reactor. Pressurizing lines 75 and 76 transmit fluid under pressure to packings 32 and 33, respectively, to prevent leakage of liquid mixture past the shaft seals for impeller shaft 8 when operating at high pressures inside the reactor.

The preferred embodiment of the present invention as shown in the drawings and described above, therefore provides a versatile mixing and heat exchange unit suitable for a wide variety of mixing and reacting functions at a wide range of temperatures and pressures. The arrangement of the components results in high energy mixing and high rates of heat transfer with very uniform temperature change through the liquid mixture, thereby enabling reactions to be carried out in much shorter times than has been possible in prior art reactors. As a result, the size and cost of the heat exchange mixer of the present invention are substantially less than for prior art reactors of equivalent throughput capacity. In addition the preferred design, as described, permits rapid and complete disassembly for cleanout or replacement of parts.

What is claimed is:

1. An apparatus for mixing at least two materials, one of which is a liquid, while simultaneously transferring heat to or from the mixture, the apparatus comprising:

a container for the materials to be mixed;

a centrifugal impeller mounted inside the container for rotation about an approximately vertical axis, the impeller having a plurality of angularly spaced blades extending outwards from an inner circumference to an outer circumference;

a structure surrounding the impeller for separating the impeller from the remainder of the container, the structure having a central inlet coaxial with the impeller axis of rotation for admitting the materials from the container to the center of the impeller and a plurality of spaced outlets surrounding the central inlet for the liquid mixture that flows from the impeller;

a plurality of inner tubes, each inner tube being connected at one end to one of the plurality of outlets in the structure for conducting the liquid mixture through the inside of the inner tube;

a plurality of outer tubes, each outer tube being closed at one end and open to the container at the other end, and each outer tube surrounding a corresponding one of the inner tubes in radially spaced relation, with the sealed end of the outer tube being spaced axially from the other end of the inner tube, whereby the mixture exiting from the other end of the inner tube will reverse direction and flow through the annular space between the inner and outer tubes and out the open end of the outer tube into the container; and means for maintaining the walls of the inner tubes at temperatures different from the temperature of the mixture flowing through the passageways for causing heat transfer between the walls and the flowing mixture.

2. An apparatus for mixing a liquid with at least one other material while simultaneously transferring heat to or from the mixture, the apparatus comprising:

a container for the materials to be mixed;

a centrifugal impeller mounted near the bottom of the container for rotation about an approximately vertical axis, the impeller having a plurality of vanes extending outward in spaced relation from an inner diameter to an outer diameter;

a structure positioned above the impeller for separating the impeller from the upper portion of the container, the structure having a central inlet coaxial with the impeller axis of rotation for admitting the materials from the container to the center of the impeller and a plurality of spaced outlets surrounding the central inlet for removing the liquid mixture that flows from the impeller;

a plurality of double-walled tubes having radially spaced inner and outer walls, each tube being connected at one end to a separate one of the plurality of outlets in the separating structure and having the other end communicating with the upper portion of the container for conducting the liquid mixture that flows from the impeller back into the upper portion of the container; and means for flowing a heat transfer fluid having a temperature different from the temperature of the liquid mixture between the inner and outer walls of the double-walled tubes from one end of each tube to the other end for transferring heat across the tube walls between the fluid and the liquid mixture.

3. The apparatus of claim 2 further comprising a plurality of additional tubes, each additional tube having a sealed end and an inner diameter greater than the outer diameter of the double-walled tubes and coaxially surrounding a corresponding one of the double-walled tubes with the sealed end of each additional tube being spaced axially from the other end of the corresponding double-walled tube and the other end of each additional tube being open to the upper portion of the container, whereby the mixture exiting from the other end of each double-walled tube will reverse direction and flow through the annular space between the double-walled tube and the additional tube and then out the open end of the additional tube into the upper portion of the container.

4. The apparatus of claim 3 wherein the means for flowing a fluid between the inner and outer walls of the double-walled tubes from one end of each tube to the other end comprises:

a plurality of spaced longitudinal partitions between the inner and outer walls of each tube for dividing the annular region between the walls into a plurality of circumferentially spaced passageways extending from one end of the tube to approximately the other end;

annular partitions at the ends of each tube for sealing the ends of the circumferentially spaced passageways, the plurality of spaced longitudinal partitions extending from the annular partition at one end of the tube alternately to the annular partition at the other end and to a location short of the annular partition at the other end, respectively, whereby pairs of the circumferentially spaced passageways adjacent to each of the shorter longitudinal partitions communicate with each other through the space between the shorter longitudinal partitions and the annular partition at the other end of the tube;

means for introducing heat exchanging fluid having a temperature different from the temperature of the liquid mixture flowing through the tube into one of each pair of the communicating adjacent passageways near the one end of each tube; and means for withdrawing the heat exchanging fluid from the other of each pair of the communicating adjacent passageways near the one end of each tube, whereby the fluid flows from the one end to the other end of the tube through the one of each pair of adjacent passageways and then returns through the other of each pair of adjacent passageways.

5. The apparatus of claim 4 wherein the means for introducing fluid into one of each pair of the communicating adjacent passageways between the inner and outer walls of each double-walled tube comprises:

a first annular plenum surrounding each double-walled tube near the one end of the tube, the outer wall of the tube having a first set of circumferentially spaced openings for connecting the first plenum with alternate ones of the longitudinal passageways between the inner and outer walls of the tube and a first conduit for connecting each first plenum with a source of heat exchanging fluid having a temperature different from the temperature of the liquid mixture flowing through the tubes; and the means for withdrawing the heat exchanging fluid from the other of each pair of the communicating adjacent passageways between the inner and outer walls of each double-walled tube comprises:

a second annular plenum surrounding each double-walled tube near the one end of the tube but axially displaced and sealed from the first plenum, the outer wall of the tube having a second set of circumferentially spaced openings for connecting the second plenum with the alternate others of the longitudinal passageways between the inner and outer walls of the tube and a second conduit connected to the second plenum for withdrawing the heat exchanging fluid to a location outside the apparatus.

6. The apparatus of claim 3 further comprising a plurality of rods, each rod having a diameter smaller than the inner diameter of a corresponding one of the plurality of double-walled tubes and being positioned to extend coaxially inside the corresponding double-walled tube for reducing the cross-sectional flow area through the inside of the double-walled tube to the annular space between the rod and the inner wall of the double-walled tube, thereby increasing the velocity of the liquid mixture through the double-walled tube and thereby improving the flow of heat between the liquid mixture and the heat transfer fluid.

7. A reactor for high energy mixing of a liquid and at least one other material while simultaneously transferring heat to or from the liquid mixture, the reactor comprising:

a closed vessel having an upper chamber, means for introducing the materials to be mixed into the upper chamber, a lower chamber, a short passageway, centrally located within the vessel, leading from the upper chamber to the lower chamber for conducting the materials to be mixed from the upper chamber into the lower chamber, a plurality of elongated thin-walled conduits leading from inlets in the lower chamber that are radially spaced from the central passageway to outlets in the upper chamber for returning the mixture of materials to the upper chamber, each elongated conduit comprising a first inner portion of annular cross section having a thin outer wall, a second outer portion of annular cross section having a thin inner wall, the second portion coaxially surrounding the first portion with the thin inner wall of the second portion being spaced radially from the thin outer wall of the first portion; the passages for the heat exchanging fluid extending between the thin outer wall of the first portion and the thin inner wall of the second portion, and a plurality of elongated passages extending along the length of each of the elongated conduits in circumferentially spaced relation on the other side of the thin wall from the flowing mixture of materials for conducting a heat exchanging fluid having a temperature different from the temperature of the mixture of materials flowing through the conduits, whereby heat transfer occurs between the heat exchanging fluid and the liquid flowing through the first portion across the thin outer wall of the first portion and between the heat exchanging fluid and the liquid mixture flowing through the second portion across the thin inner wall of the second portion;

a centrifugal impeller mounted in the lower chamber for rotation about an axis coincident with the axis of the central passageway, the impeller having a plurality of blades extending outward from an open eye at the center of the impeller to the outer circumference of the impeller; and drive means for rotating the impeller about its axis, whereby the materials to be mixed are drawn from the upper chamber through the central passageway into the eye of the impeller, then are impelled outward between the rotating blades which impart kinetic energy to the mixture as it flows through the impeller, and finally are returned through the plurality of elongated conduits to the upper chamber, there being sufficient clearance between the upper face of the impeller and the wall of the lower chamber in the region between the central passageway and the plurality of radially spaced inlets of the elongated conduits to permit rotation of the impeller while preventing any significant recirculation of the mixture directly from the high pressure region at the outer circumference of the impeller to the low pressure region at the eye of the impeller.

8. The apparatus of claim 1 wherein the inner tube of each elongated passageway comprises the circumscribing wall maintained at a temperature different from the temperature of the flowing mixture.

9. The apparatus of claim 8 wherein the inner tube comprises coaxial, radially spaced inner and outer walls, and the means for maintaining the inner tube at a temperature different from the temperature of the mixture flowing through the elongated passageway comprises means for passing a heat exchange fluid having a temperature different from the mixture temperature through the space between the inner and outer walls.

10. The apparatus of claim 9 wherein the means for passing a heat exchange fluid through the space between the inner and outer walls of each inner tube comprises:

an inlet opening for said heat exchange fluid through the outer wall, an outlet opening for said heat exchange fluid through the outer wall angularly spaced from the inlet opening, and a longitudinal baffle extending radially between the inner and outer walls and longitudinally between the inlet and outlet openings for diverting the flow of heat exchange fluid from following a direct path between the inlet and outlet openings.

* * * * *